United States Patent [19]

Julian

[11] Patent Number: 4,932,896

[45] Date of Patent: Jun. 12, 1990

[54] CABLE WITH A JUMPER TERMINAL

[76] Inventor: Kenneth A. Julian, 409 Suffolk La., Oak Brook, Ill. 60521

[21] Appl. No.: 386,247

[22] Filed: Jul. 28, 1989

[51] Int. Cl.[5] ..... H01R 11/00

[52] U.S. Cl. ..... 439/504; 439/754; 439/756

[58] Field of Search ..... 439/502–504, 439/754–756, 766

[56] References Cited

U.S. PATENT DOCUMENTS

| | | | |
|---|---|---|---|
| 3,992,075 | 11/1976 | Cannarsa | 439/766 |
| 4,118,097 | 10/1978 | Budnick | 439/766 |
| 4,126,367 | 11/1978 | Miller | 439/504 |
| 4,288,504 | 9/1981 | Julian et al. | 439/504 |
| 4,483,910 | 11/1984 | Julian | 439/504 |

*Primary Examiner*—P. Austin Bradley

*Attorney, Agent, or Firm*—Edmond T. Patnaude

[57] ABSTRACT

A self-contained jumper terminal assembly includes a battery terminal connector connected by an insulated cable to a remotely located jumper terminal for connection to one of the alligator clip connectors of a jumper cable. The jumper terminal is connected to one end of the insulated cable and an insulating cover member encloses the associated end of the cable and includes a mounting through-hole and a raised annular flange surrounding the mounting hole.

4 Claims, 1 Drawing Sheet

CABLE WITH A JUMPER TERMINAL

The present invention relates in general to jumper terminals for automotive vehicles, and it relates more particularly to a new and improved jumper terminal assembly for use in jump starting one vehicle from another.

BACKGROUND OF THE INVENTION

In order to facilitate the connection of jumper cables from one vehicle to another it would be desirable to provide an auxiliary terminal connected to the hot terminal of the associated battery to which an alligator type clip on the jumper cables can be easily attached. For safety purposes it is desirable that the jumper cables not be connected directly to the battery, and it is desirable for the auxiliary jumper terminal to be located a substantial distance away from and preferably below the top of the battery.

SUMMARY OF THE INVENTION

Briefly, in accordance with the present invention there is provided a jumper cable assembly which is adapted to be mounted to a wall or floor of a vehicle and which is adapted to be electrically connected to one terminal of the battery of the vehicle. The assembly includes an upstanding terminal stud which is well adapted to be grasped by an alligator clip of a conventional jumper cable.

GENERAL DESCRIPTION OF THE DRAWING

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

Figure 1:
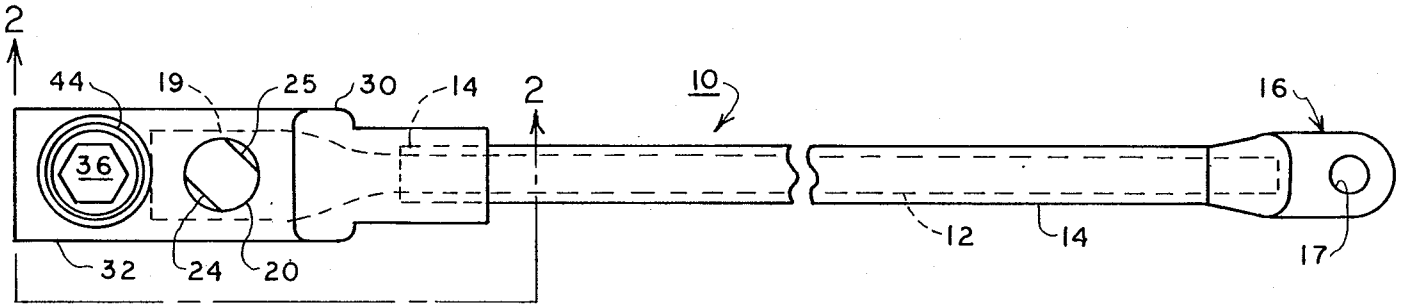
FIG. 1 is a plan view of a jumper terminal assembly embodying the present invention.
Figure 2:
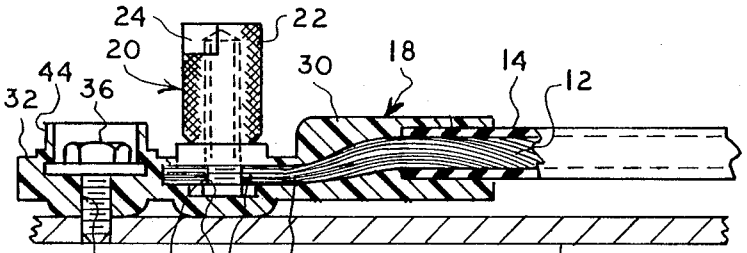
FIG. 2 is a cross-sectional view taken along the line 2—2 of FIG. 1.

Referring to FIG. 1 there is shown a jumper terminal assembly 10 including as its principal elements a stranded wire cable 12 enclosed in an insulating cover 14, a terminal member 16 formed of metal and having an aperture 17 therein for receiving a battery terminal, and a jumper terminal subassembly 18. The terminal member 16 and the subassembly 18 are electrically and mechanically connected to the opposite ends of the cable 12.

As may be seen in the drawings, the end portion of the stranded wire cable 12 which is connected to the subassembly 18 is identified by the number 19 and is flattened at the location where a jumper terminal member 20 is connected thereto. Considered in greater detail, the terminal member 20 includes cylindrical body portion having a knurled outer surface 22 and a pair of parallel flats 24 and 25 at the top for receiving the jaws of a wrench. The terminal member 20 further includes a threaded shank portion 26 which is threaded into an aperture 28 provided in the flattened portion 19 of the cable 12. Preferably, the flattened portion 19 is dipped solder after the flattening operation to provide a solid member into which the terminal 20 is threaded.

The subassembly 18 further includes an insulating cover 30 formed of rubber or plastic and which encloses the flattened end portion of the cable 12 and the end portion 14a of the insulating cable cover 14. It is preferred for the cover 30 and the cable cover 14 to be bonded together. In addition, the covering 30 has a portion 32 which extends a substantial distance outwardly beyond the distal end of the flattened portion 19 of the cable 12. A hole 34 extends through the cover portion 32 and is adapted to receive a headed mounting screw 36 which attaches the subassembly to a floor or bulkhead 40 of a vehicle. The bottom surface 42 of the cover 30 is planar so as to lie flat against the adjacent surface of the member 40. In order to prevent the jumper cable connector from being short circuited to the member 40 through the mounting screw 36, the cover 30 includes an integral upstanding annular flange 44 surrounding the hole 34 and which extends a substantial distance above the head of the mounting screw 36 when the subassembly 18 is mounted to the member 40.

It may thus be seen that the present invention provides a self-contained jumper terminal and cable assembly which is strong and durable in construction, which is easily mounted to a floor or bulkhead of a vehicle to provide a conveniently located terminal for connecting a jumper cable and battery terminal for connecting the jumper terminal to a remotely located battery.

While the present invention has been described in connection with a particular embodiment thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed is:

1. A jumper terminal assembly for connection to the battery of a vehicle, comprising in combination a terminal member for attachment to a terminal of said battery, a jumper terminal assembly for attachment to a surface of said vehicle at a location remote from said battery, an insulated electric cable connected between said terminal member and said jumper terminal assembly, said jumper terminal assembly including an upstanding terminal stud member electrically and mechanically connected directly to said cable, and an insulating cover enclosing the associated end of said cable, and said insulating cover being provided with an opening for receiving a mounting fastener.

2. A jumper terminal assembly according to claim 1, wherein said insulating cover comprises an integral, upstanding annular flange surrounding said opening.

3. A jumper terminal assembly according to claim 2, wherein a distal end portion of said cable extends into said insulating cover, said distal end portion of said cable is flattened and provided with a hole therethrough, and said terminal member includes a shank portion mounted in said hole.

4. A jumper terminal according to claim 3, wherein said hole is provided with an internal thread, said shank portion of said terminal member is provided with an external thread, and said shank portion is threadedly received in said hole.

* * * * *